US005083939A

United States Patent [19]

Ittah

[11] Patent Number: 5,083,939

[45] Date of Patent: Jan. 28, 1992

[54] MALE ELECTRICAL CONTACT MEMBER AND COMPLEMENTARY ELECTRICAL CONNECTOR SHELL

[75] Inventor: Jean Ittah, Villeneuve la Garenne, France

[73] Assignee: Labinal S.A., Montigny le Bretonneux, France

[21] Appl. No.: 611,882

[22] Filed: Nov. 13, 1990

[30] Foreign Application Priority Data

Nov. 10, 1989 [FR] France ..... 89 14779

[51] Int. Cl.[5] ..... H01R 13/00

[52] U.S. Cl. ..... 439/496

[58] Field of Search ..... 439/492–499

[56] References Cited

U.S. PATENT DOCUMENTS 3,154,365 10/1964 Crimmins ..... 439/496
3,638,164 1/1972 Glance ..... 439/496
3,753,207 8/1973 Maheux et al. .
3,897,130 7/1975 Donnelly et al. .

FOREIGN PATENT DOCUMENTS 2110967 6/1972 France .

*Primary Examiner*—Joseph H. McGlynn
*Attorney, Agent, or Firm*—Sandler, Greenblum & Bernstein

[57] ABSTRACT

Male electrical contact member for connection to a complementary electrical connector shell, which includes a connector shell which is shaped to receive an insulative material block having a heel-piece and at least one projection. The heel-piece includes at least one passage for a folded conductor fixed to the projection. The connector shell further includes elements for locking the heel-piece into the housing and at least one aperture through which the projection covered with the conductor may pass.

38 Claims, 6 Drawing Sheets

FIG. 3
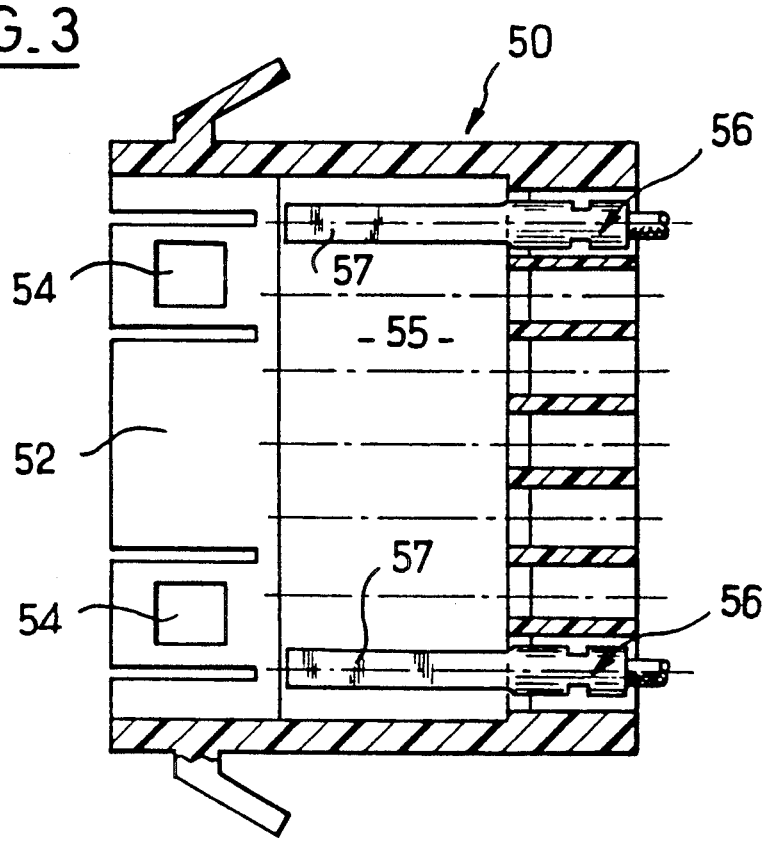
FIG. 5
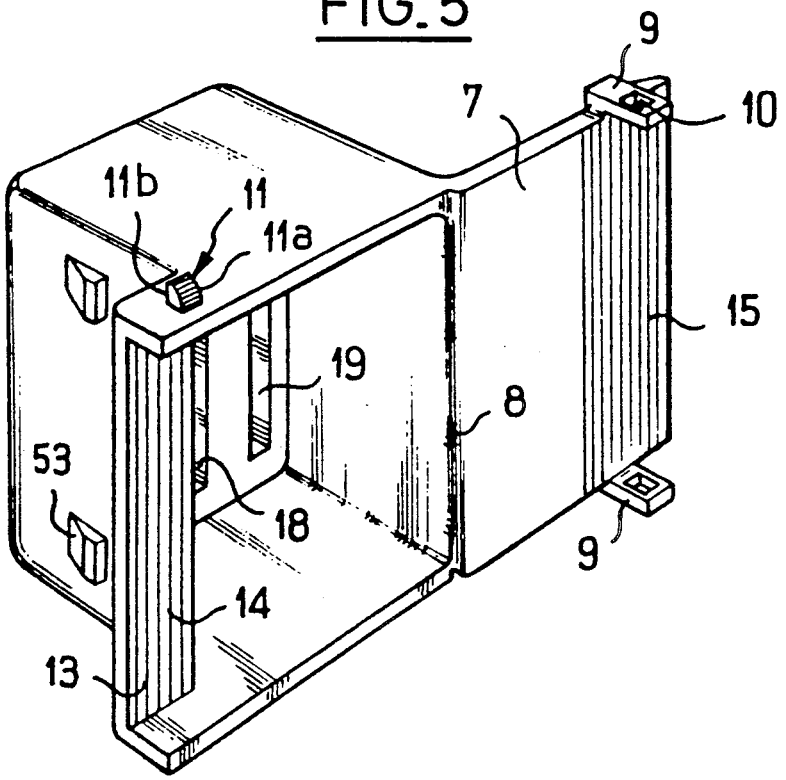
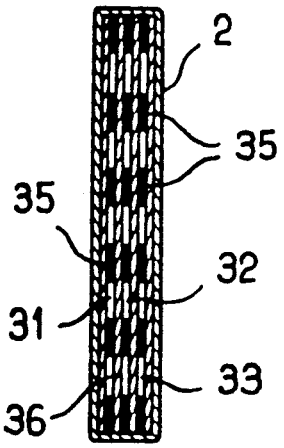
FIG. 7

MALE ELECTRICAL CONTACT MEMBER AND COMPLEMENTARY ELECTRICAL CONNECTOR SHELL

BACKGROUND OF THE INVENTION

1. Field of the Invention

The present invention concerns a male electrical contact member and its associated electrical connector shell.

2. Discussion of Background and Material Information

Male electrical contacts are usually in the form of a bar or tang including at one end means for fixing the contact to an electrical conductor and adapted at the other end to be inserted into a pincer-type female member.

These parts are very well known and find many uses which include, amongst others, applications in the automobile and aeronautical industries, as well as in domestic electrical appliances.

The male members are usually housed in cavities in a connector shell and the female members also are usually housed in a complementary connector shell.

When the number of connections to be made to the connector shells is large, the connector shells necessarily become fairly bulky. Also, a conductor has to be fixed to each male member, which is relatively time-consuming.

One object of the present invention is to overcome these disadvantages.

SUMMARY OF THE INVENTION

The present invention is directed to a male electrical contact member and corresponding electrical connector shell wherein the member comprises a insulative material block incorporating a heel-piece and at least one projection. The heel-piece includes at least one passage for a folded conductor which is fixed to the projection. The connector shell is shaped to define a housing adapted to receive the heel-piece, and includes means for locking the heel-piece into the housing and at least one aperture adapted to have the projection passed through it.

The resulting male electrical contact member is advantageous due to its simple construction, and the fact that the conductor does not have to be soldered or crimped to it.

In one embodiment, the insulative material block comprises a series of projections understanding from one side of the heel-piece. Moreover, the heel-piece includes a series of slots opening onto the side of the heel-piece opposite that carrying the projections.

In another embodiment, the apertures in the connector shell have a width corresponding to the thickness of a corresponding projection when fitted with a conductor so that, when the projections are inserted into the apertures, the conductors are gripped between the edges of the apertures and the projections.

Each conductor may be adhesively bonded to its projection and/or the projection may include a conductor fixing member, such as a peg.

The projections are preferably elongate. Also, the conductors can be arranged side-by-side to produce a more compact assembly.

In one embodiment the means for locking the heel-piece in the housing includes lugs on the inside side wall of the housing adapted to cooperate with an edge of the heel-piece.

According to one constructive feature, the means for locking the heel-piece in the housing include a cover articulated to one edge of the connector shell in the closed position.

To prevent the conductor from being pulled out of the connector shell, each part of the connector shell includes an extension forming a passage for the conductors and each part is provided with grooves or beads for clamping the conductor.

In one embodiment, the block comprises an elongate projection fixed at one end on one side of the heel-piece, which is extended at its ends by two cheeks which form on the side of the projection opposite the heel-piece shoulders for defining the conductor passage. Pegs are attached to the projection on the same side as the heel-piece which constitute conductor fixing means.

In one embodiment the connector shell is extended by a skirt extending around the projection and is provided with means for receiving and fixing a complementary shell part fitted with at least one complementary female electrical contact member.

In other aspect, the invention consists in an application of the male electrical contact member and the corresponding electrical connector shell as discussed above to making electrical connections from the interior of a vehicle through the door of the vehicle. In such use, two connector shells connected by a flexible duct containing ribbon cables comprising flat conductors embedded in an insulative material are provided. Each ribbon cable is stripped at its free end, and the block disposed in the housing in each connector shell includes a series of projections receiving the stripped end guided in the respective passage in the heel-piece.

In this manner, the complementary connector shells containing the female contact members are fixed in the car body and in the door, and the connector shells are fixed to said complementary connector shells. This simplifies assembly and avoids the need to pass wires through sheaths passing through the edge of the door and the edge of the body, which is both time-consuming and costly.

According to another feature of the invention, the ribbon cables are all substantially the same length and the distances between the projections are compensated by folding the ribbon cable in the housing.

More specifically, the above-noted objects may be achieved by the present invention by providing a male electrical contact member comprising a connector shell including a housing; an insulative material block including at least one heel-piece and at least one projection, the insulative material block having at least one passage through which a conductor is capable of passing; the housing being capable of receiving said insulative material block and including a wall having at least one aperture through which the at least one projection may be inserted; and means for locking the insulative material block in the housing when the at least one projection is inserted into the at least one aperture.

The insulative material block may include a series of projections upstanding from one side of the at least one heel-piece, and a series of corresponding slots which open on the side of the at least one heel-piece on which the series of projections are located, and onto the side of the at least one heel-piece opposite that carrying the series of projections. Each slot in the series of corresponding slots may open on the side of the at least one heel-piece on which the series of projections are located at a position that is substantially adjacent to a corresponding projection.

The at least one aperture in the wall may have a width corresponding to the thickness of the at least one projection when fitted with a conductor, so that when the at least one projection fitted with a conductor is inserted into the at least one aperture, each respective conductor is gripped between the edges of the at least one aperture and a corresponding at least one projection.

The at least one conductor may be adhesively bonded to the at least one projection and/or there may be means for fixing a conductor to the at least one projection. Such means for fixing the conductor may be at least one peg. Moreover, the means for fixing a conductor may include an end portion of the at least conductor which extends past the at least one projection to be wedged between the wall and the insulative material block. Also, the at least one projection may comprise an elongated member.

The means for locking the insulative material block in the housing may comprise lugs on an inside side wall of the housing adapted to cooperate with an edge of the insulative material block. Moreover, the means for locking the insulative material block in the housing may comprise a cover articulated to one edge of the housing having means for locking the cover to the housing in a closed position. The cover and the housing may each include an extension forming a passage for at least one conductor, and further including means for clamping the at least one conductor in the passage. The means for clamping may comprise grooves or beads located on each extension.

The housing may include a skirt extending around the at least one projection for receiving a complementary shell part including at least one complementary female electrical contact member. The skirt may include means for fixing the skirt to the complementary shell part.

The at least one projection may have opposing sides and a first end that is fixed to the heel-piece, with the heel-piece being on one side of the projection. The heel-piece is extended at its ends by two cheeks which extend to the other side of projection to form thereon shoulders for defining the at least one passage for a conductor. Pegs may be included on the projection on the side on which the heel-piece is affixed for attaching a conductor.

The male electrical contact member may include at least two projections and at least two conductors, with each conductor being of substantially the same length, and each conductor being folded to the extent necessary to overlap its corresponding projection.

In another aspect of the invention, there is provided a combination of the male electrical contact member with at least conductor and at least one complementary shell part.

In still another aspect of the invention, there is provided an electrical connector device comprising two connector shells, with each connector shell including a housing; at least one conductor; two insulative material blocks, with each insulative material block including at least one heel-piece and at least one projection, the at least one heel-piece having at least one passage through which the at least one conductor is capable of passing; the housing of each of the connector shells being capable of receiving one of the insulative material blocks and including a wall having at least one aperture through which the at least one projection may be inserted; and means for locking the insulative material block in each housing of each of the connector shells when the at least one projection is inserted into the at least one aperture.

Moreover, according to another aspect of the present invention, there is provided a male electrical contact member comprising a connector shell including a housing having a wall including at least one aperture; an insulative material block comprising at least one elongated member for receiving a conductor thereon; the housing is capable of receiving the insulative material block with the at least one elongated member projecting through the at least one aperture; and means for locking the at least one elongated member in the housing when the elongated member is inserted in the at least one aperture.

In this aspect of the present invention, the at least one elongated member may include a projection having opposing sides and a first end that is fixed to a heel-piece on one side of the projection, the heel-piece may be extended at its ends by two cheeks which extend to the other side of the projection to form thereon shoulders for defining a passage for a conductor. At least one peg may be located on the projection on the side on which the heel-piece is affixed for attaching a conductor. Also, there may be included therewith the combination of at least one conductor and at least one complementary shell part.

In another aspect of the present invention, there may be provided an electrical connector device, comprising two connector shells, with each connector shell including a housing having a wall including at least one aperture; two insulative material blocks, with each of the two insulative material blocks comprising at least one elongated member for receiving a conductor thereon; each of the housings may be capable of receiving the insulative material block with the at least one elongated member projecting through the at least one aperture; and means for locking the at least one elongated member in each housing when the elongated member is inserted in the at least one aperture.

Additionally, in another aspect of the present invention, there is provided a method of making an electrical connection comprising providing an electrical connector device which includes two connector shells, with each connector shell including a housing; at least one flexible duct containing at least one ribbon cable conductor; an insulative material block including at least one heel-piece and at least one projection, the insulative material block having at least one passage through which the at least one ribbon cable conductor is capable of passing; each housing being capable of receiving the insulative material block and including a wall having at least one aperture through which the at least one projection may be inserted; and means for locking the insulative material block in each housing when the projection is inserted into the at least one aperture; and connecting and locking the two connector shells to opposite ends of the flexible duct so that the at least one ribbon cable conductor is positioned over the at least one projection.

Moreover, two complementary shell parts may be provided, with each complementary shell part including at least one complementary female electrical contact member, and the method includes connecting each of the two connector shells to a respective one of the complementary shell parts.

The at least one ribbon cable conductor may be stripped at least in a portion overlapping the at least one projection so as to project past the at least one aperture. Further, the insulative material block may include a series of projections upstanding from one side of the at least one heel-piece; and a series of corresponding slots which open on the side of the at least one heel-piece on which the series of projections are located, and onto the side of the at least one heel-piece opposite that carrying the series of projections. Each slot in the series of corresponding slots may open on the side of the heel-piece on which the series of projections are located at a position that is substantially adjacent to a corresponding projection.

Moreover, in the method the complementary shell parts may be attached to the interior of a vehicle and the door of the vehicle for attachment to the two shells of the electrical connector.

The invention will now be described in more detail with reference to embodiments shown by way of example only in the appended diagrammatic drawings. Moreover, each of the various aspects of the present invention may include various combinations of the above-described features.

BRIEF DESCRIPTION OF DRAWINGS

Other characteristics, and advantages of the invention will become clear from the description which follows with reference to the annexed drawings, which are given by way of non-limiting examples only, in which:

FIG. 3 illustrates in cross-section a view of part of the complementary shell along line 3—3 in FIG. 2.

FIG. 5 illustrates a perspective view of a connector shell of a first embodiment according to the present invention.

FIG. 7 illustrates in cross-section and to a larger scale a view of the flexible duct according to the present invention.

DETAILED DESCRIPTION OF THE PREFERRED EMBODIMENTS

Figure 1:
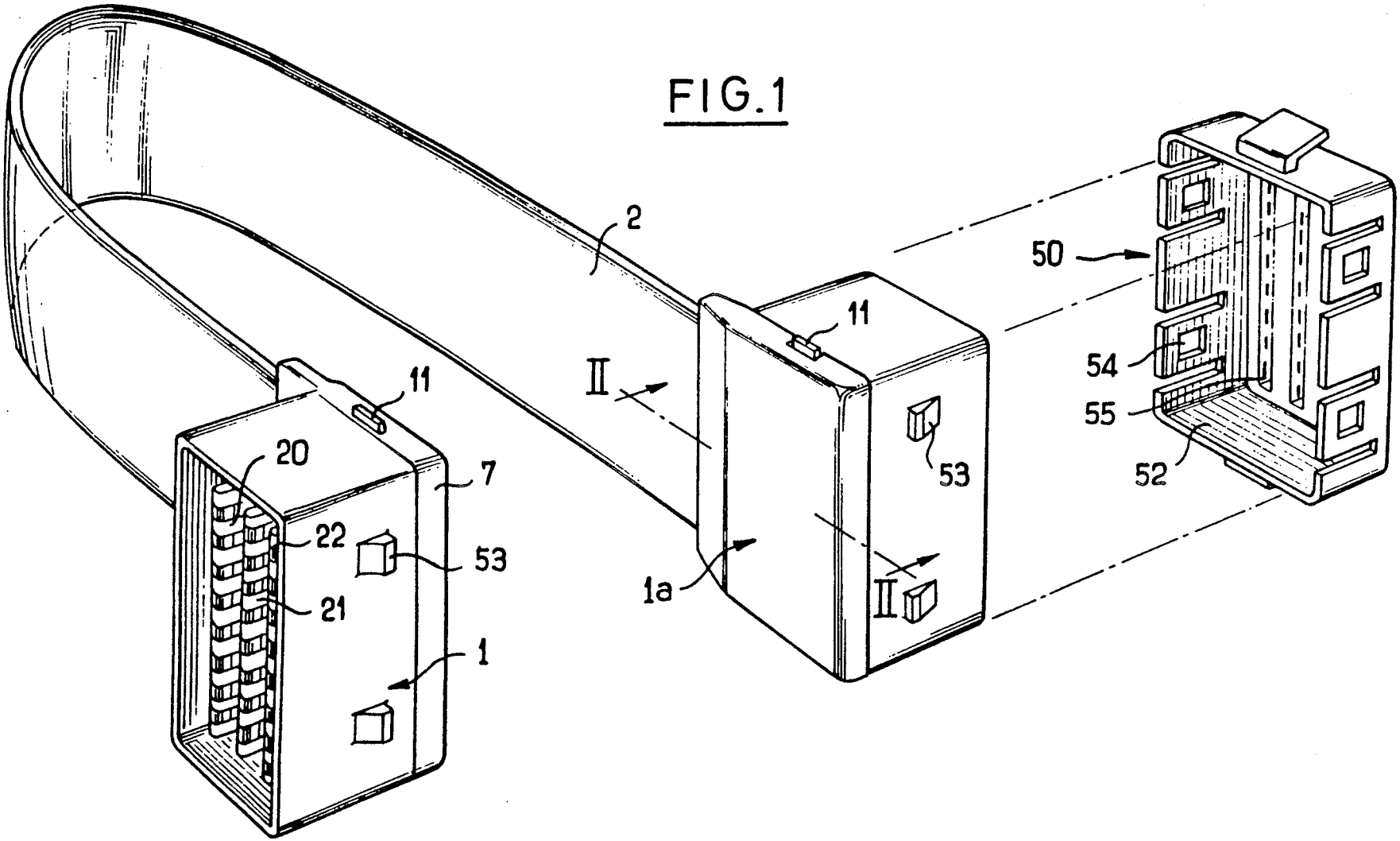
FIG. 1 illustrates a perspective view of the electrical connector member and electrical connector shell in accordance with the present invention.

The device illustrated in the figures comprises two connector shells 1 and la connected by a flexible duct 2.

The connector shells 1 and 1*a* are composed of a molded plastics material body 3 having an inner wall 4 on one side of which is located a skirt 5, and on the other side of which is located a housing 6. The housing 6 may be closed by a cover 7, which is hinged along one edge by means of a reduced thickness portion forming a hinge 8.

The cover 7 carries two tabs 9, with each tab 9 including therein a hole 10 adapted to cooperate by virtue of resilient deformation with lugs 11 on the body 3.

Each lug 11 includes a ramp surface 11*a* ending at a steep side 11*b* so that, when the cover 7 is manipulated to its closed position, the tabs 9 are pushed apart by the ramp surfaces 11*a* to permit latching when the holes 10 fit over the steep edges 11*b*.

On the side opposite the hinge 8, the body 3 includes an extension 13 having grooves 14 on the side towards the cover. Moreover, the corresponding portion of the cover 7 includes grooves 15. Accordingly, when the cover is closed, a passage having retaining means is formed.

The housing 6 includes an insulative material block 25 having a heel-piece 29 whose shape matches that of the housing 6, and which includes a lower surface 30 and an upper surface $30^1$. The insulative material block 25 includes three projections 20, 21 and 22 on its upper surface $30^1$, and incorporates three slots or openings 26, 27 and 28, with each slot being associated with one of the three projections 20, 21 and 22. The slots 26, 27 and 28 have at least a portion that diverges towards the lower surface 30, at least in that area of the heel-piece 29 located adjacent the lower surface 30.

Slot 26 extends from one side 30 of the heel-piece 29 to the other side $30^1$ along one edge of the projection 20. Slot 27 extends from the side 30 of the heel-piece 29 to the other side $30^1$ along one edge of the projection 21. Slot 28 extends from the side 30 of the heel-piece 29 to the other side $30^1$ along one edge of the projection 22.

The inner wall 4 of the body 3 includes three slots or openings 17, 18 and 19 through which the three projections 20, 21 and 22 pass.

Three ribbon cables 31, 32 and 33, each cut to substantially the same length, are accommodated in the flexible duct 2, with each ribbon cable comprising flat electrical conductors 35 embedded in insulative material 36. The ribbon cable 31 is stripped on one side to bare the conductors 35 in an area adapted to be fitted over the projection 20, the stripped side facing outwards. In a similar manner, the ribbon cable 32 is stripped on one side adapted to be fitted over the projection 21, and the ribbon cable 33 is stripped on one side adapted to be fitted over the projection 22.

Figure 2:
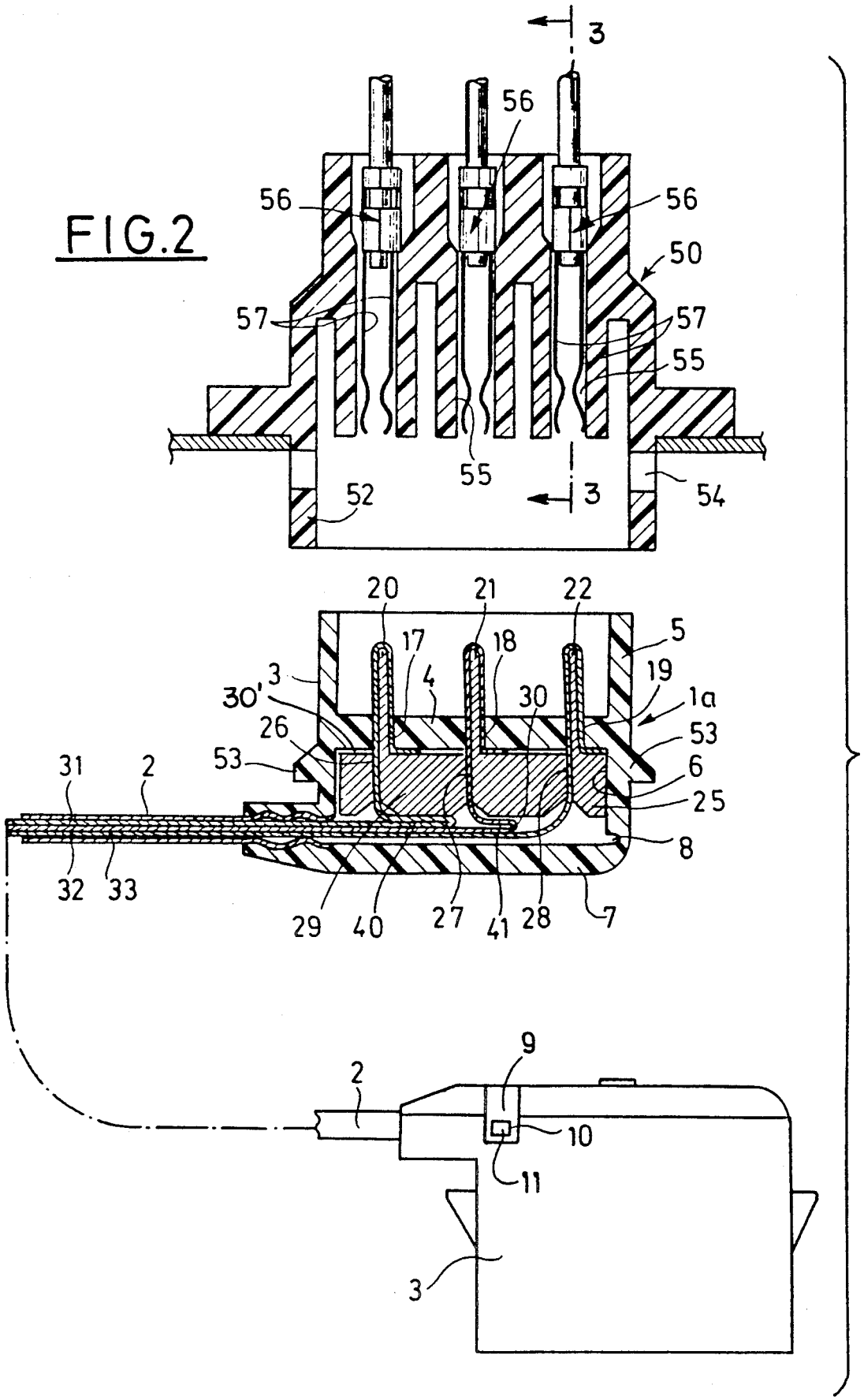
FIG. 2 illustrates a view of the electrical connector member and electrical connector shell partially in cross-section and to a larger scale, in accordance with a first embodiment of the present invention.
Figure 4:
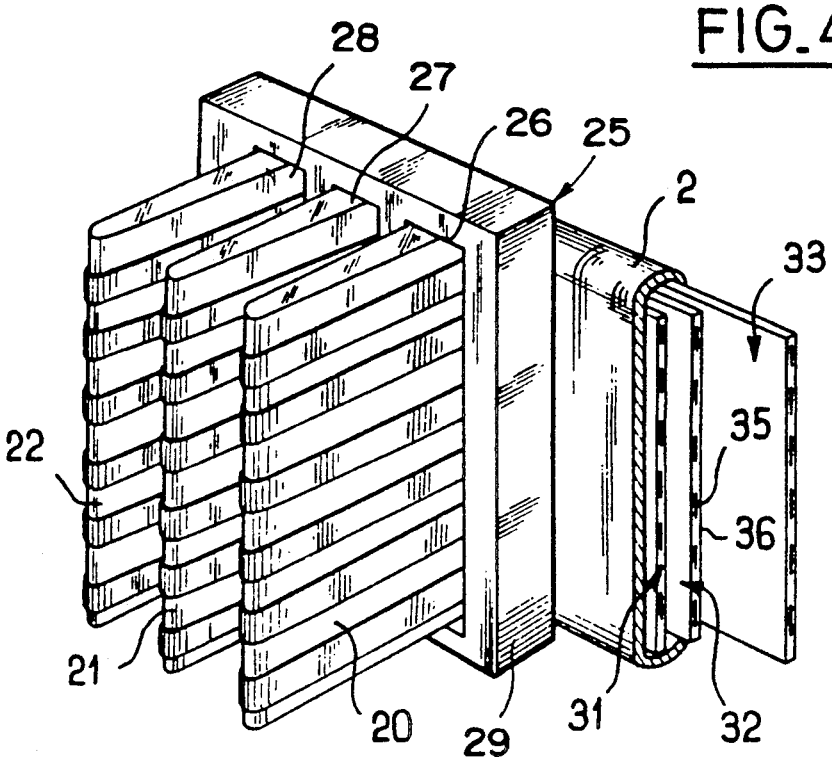
FIG. 4 illustrates a perspective view of a block according to a first embodiment of the present invention.
Figure 6:
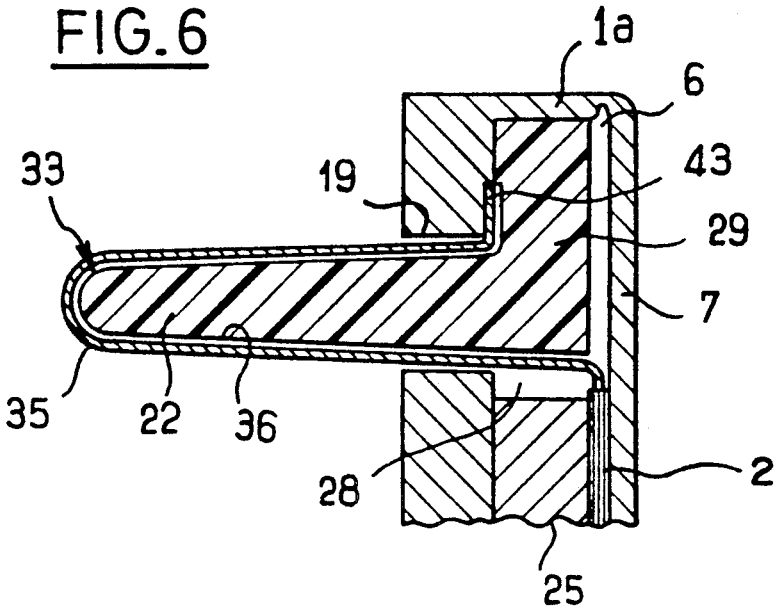
FIG. 6 illustrates in cross-section and to a larger scale a portion of the electrical connector shell.
Figure 8:
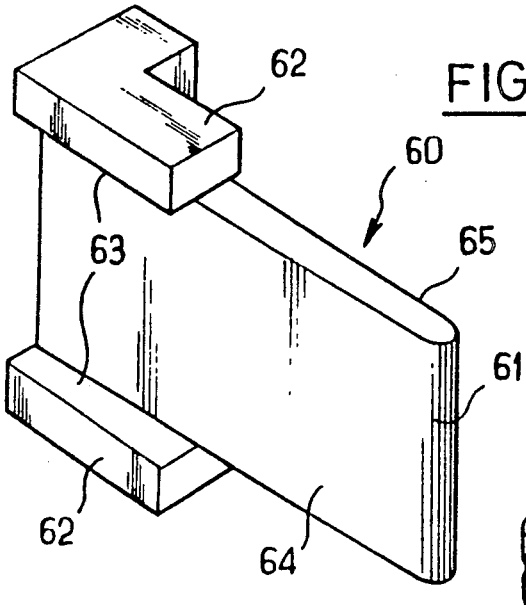
FIG. 8 illustrates a perspective view of an element of the block in accordance with a second embodiment of the present invention.
Figure 9:
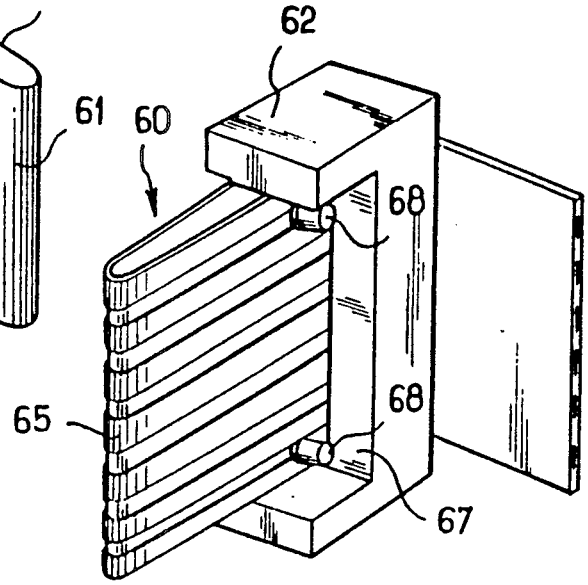
FIG. 9 illustrates a perspective view of an element of the block in accordance with the second embodiment of the present invention.

Referring to FIG. 2, due to the fact that ribbon cables 31, 32 and 33 are of substantially the same length, it is seen that ribbon cable 31 is formed into a broad fold 40, ribbon cable 32 into a narrow fold 41, and ribbon cable 33 is exactly the right length. In other words, the folds 40 and 41 accommodate the surplus length of the ribbon cables 31 and 32 which results from the shorter distances required to reach projections 20 and 21.

The unstripped side of each ribbon cable 31, 32 and 33 is applied to projections 20, 21 and 22, respectively, with a small end-piece 43 of each ribbon cable being formed adjacent each projection. Accordingly, when the insulative material block 25 is inserted into the housing 6, and the projections 20, 21 and 22 pass through slots 17, 18 and 19, respectively, the small end-pieces 43 for each ribbon cable is wedged between upper surface $30^1$ and wall 4. Moreover, as the block 25 is fitted into the housing 6, the ribbon cables are locked into the corresponding slots 17, 18 and 19.

Additionally, after the block 25 is inserted into place and the ribbon cables are locked in the body 3, the flexible duct 2 and the ribbon cables 31, 32 and 33 are clamped in the passage formed between the extension 13 of the body 3 and the cover 7. In particular, the cover is manipulated to its closed position, whereby lugs 11 are positioned and locked in holes 10 of tabs 9, with the grooves 14 and 15 preventing the duct and the ribbon cables from being pulled out.

To facilitate mounting the ribbon cables 31, 32 and 33 on the respective projections 20, 21 and 22, the side of the ribbon cables in contact with the projections may be adhesively bonded to them.

The connector shell 1 or 1*a* additionally comprises a complementary shell part 50 adapted to be fixed to a wall and incorporating a skirt 52. The skirt 52 is adapted to fit over the skirt 5, which carries lugs 53 adapted to cooperate with holes 54 in the skirt 52. The complementary shell part 50 includes channels 55 into which female contact members 56 are locked, which female contact members have two spring tangs 57 adapted to grip the respective projections 20, 21 and 22 to thereby engage conductors 35 of the ribbon cables.

The present invention finds a particularly beneficial application in making electrical connections to the doors of vehicles. In such instance, the vehicle includes a first complementary shell part 50 in its interior, and a second complementary shell part 50 on the door. These two shell parts receive the electrical connector shells 1 and 1*a*. To be aesthetically pleasing, the color of the duct 2 may be compatible with that of the interior of the vehicle.

FIGS. 8 through 11 illustrate another embodiment of the present invention. In this embodiment, the block is in the form of multiple elements 60, with each element 60 including a projection 61 and two cheeks 62 which form shoulders 63 on at least one side 64 of the projection 61 and are joined by a heel-piece 67 on its other side. Two pegs 68 are provided near the heel-piece 67 for fixing the ribbon cable in place, as will be described below.

Figure 10:
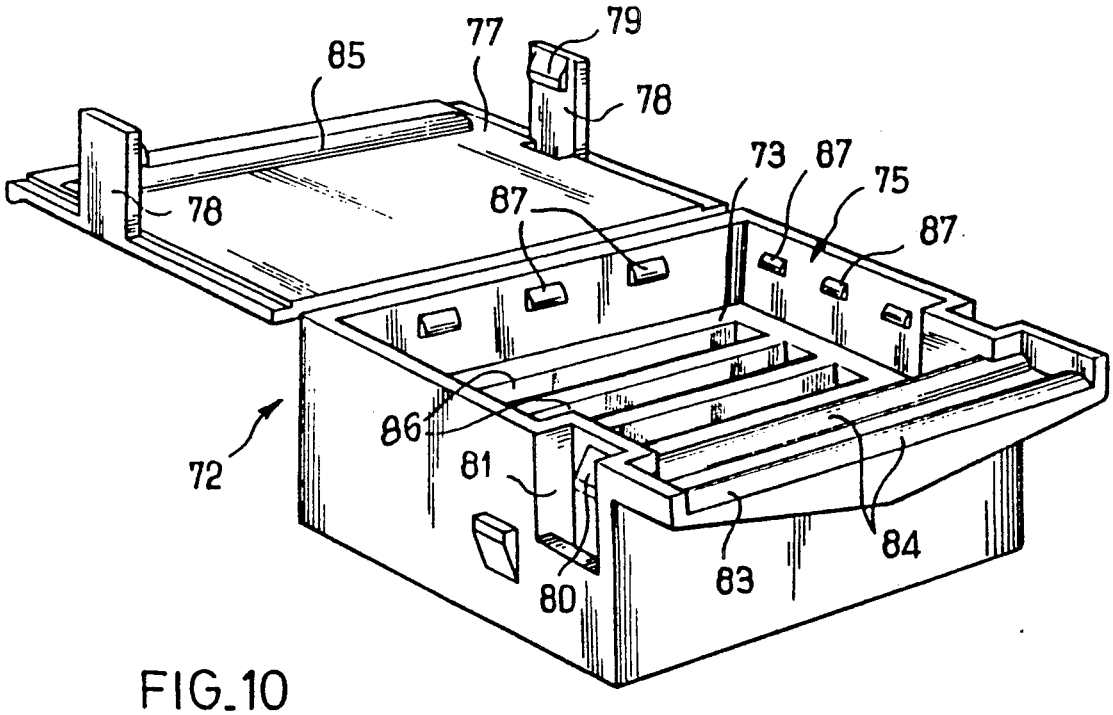
FIG. 10 illustrates a perspective view of an electrical connector shell in accordance with the second embodiment of the present invention.
Figure 11:
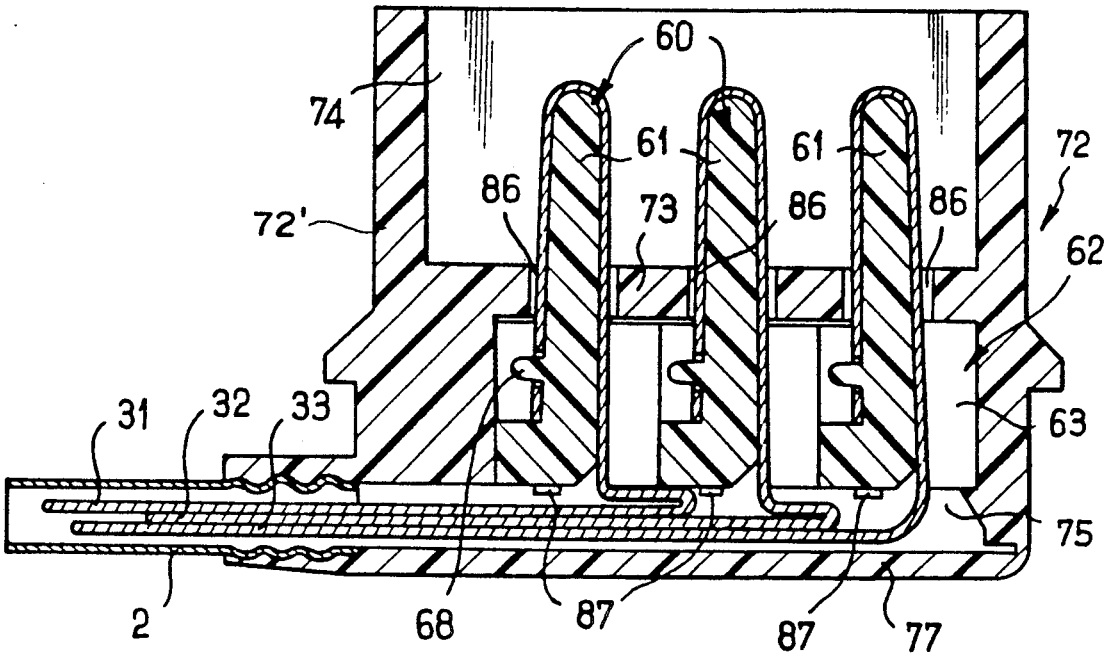
FIG. 11 illustrates in cross-section the electrical connector shell in accordance with FIG. 10 fitted with the elements shown in FIGS. 8 and 9.

FIG. 10 shows an electrical connector shell 72 designed to receive three of the elements 60. The connector shell 72 is composed of a molded plastics material body $72^1$ having a skirt 74 on one side of an inner wall 73 and a housing 75 on the other side of the inner wall 73.

To one edge of the body $72^1$ on side of the housing 75 is located a cover 77 which is adapted to close the housing and which carries two resilient tabs 78. Each resilient tab 78 includes a lug 79 that is designed to cooperate with a respective lug 80 in grooves 81 on the body $72^1$. Accordingly, when the cover 77 is closed the tabs 78 are flush with the corresponding walls and do not project.

In a manner similar to that for the first embodiment illustrated in FIGS. 1 through 7, the body $72^1$ includes an extension 83 on which are located beads 84, and the free edge of the cover 77 carries similar beads 85 so that when the cover is closed the ribbon cables 31, 32 and 33 in the flexible duct 2 are clamped.

The wall 73 of the housing $72^1$ incorporates slots 86 through each of which passes a projection 61. The corresponding ends of the cheeks 62 bear against the side of the wall 73 towards the housing 75, which is provided with lugs 87 for locking the elements 60 in place.

The ribbon cables 31, 32 and 33 in FIGS. 8 through 11 are mounted on the projections 61 in the same way as in the previous example, except that the ends of the ribbon cables are pushed onto the pegs 68. In this regard, the ribbon cables may include respective apertures therein to fit on the pegs 68. Moreover, the ribbon cables may be adhesively bonded to the projections 61.

The electrical connector shell 72 is adapted to cooperate with a complementary shell part 50 in a similar manner to that described and illustrated for the first embodiment of the present invention, as shown in FIG. 2.

The figures illustrate embodiments in which each projection receives one ribbon cable with multiple conductors each adapted to cooperate with a female contact member 56. It is also perfectly feasible to form a male connector with a single projection fitted with a single conductor and adapted to cooperate with a single female contact member 56.

This application is related to French Application No. 89.14779 filed on Nov. 10, 1990, whose priority is claimed, the disclosure and drawings of which are incorporated by reference thereto in their entirety.

Although the invention has been described with reference to particular means, materials and embodiments, it is to be understood that the invention is not limited to the particulars disclosed and extends to all equivalents within the scope of the claims. Numerous modifications of detail may be made thereto without departing from the scope of the invention.

What is claimed is:

1. Male electrical contact member comprising:

a connector shell including a housing;

an insulative material block including at least one heel-piece and at least one projection, said insulative material block having at least one passage through which a conductor is capable of passing;

said housing being capable of receiving said insulative material block and including a wall having at least one aperture through which said at least one projection may be inserted; and means for locking said insulative material block in said housing when said at least one projection is inserted into said at least one aperture.

2. The male electrical contact member according to claim 1, wherein said at least one aperture in said wall has a width corresponding to the thickness of said at least one projection when fitted with a conductor, so that when said at least one projection fitted with a conductor is inserted into said at least one aperture, each respective conductor is gripped between the edges of said at least one aperture and a corresponding at least one projection.

3. The male electrical contact member according to claim 1, further including at least one conductor, and wherein said at least one conductor is adhesively bonded to a corresponding at least one projection.

4. The male electrical contact member according to claim 1, wherein said at least one projection comprises an elongated member.

5. The male electrical contact member according to claim 1, wherein said means for locking said insulative material block in said housing comprise lugs on an inside side wall of said housing adapted to cooperate with an edge of said insulative material block.

6. The male electrical contact member according to claim 1, including at least two projections and at least two conductors, with each conductor being of substantially the same length, and each conductor being folded to the extent necessary to overlap its corresponding projection.

7. The male electrical contact member according to claim 1, wherein said insulative material block includes a series of projections upstanding from one side of said at least one heel-piece; and a series of corresponding slots which open on said side of said at least one heel-piece on which said series of projections are located, and onto the side of said at least one heel-piece opposite that carrying said series of projections.

8. The male electrical contact member according to claim 7, wherein each slot in said series of corresponding slots opens on said side of said at least one heel-piece on which said series of projections are located at a position that is substantially adjacent to a corresponding projection.

9. The male electrical contact member according to claim 1, further including means for fixing a conductor to said at least one projection.

10. The male electrical contact member according to claim 9, wherein said means for fixing a conductor comprises at least one peg.

11. The male electrical contact member according to claim 9, further including at least one conductor, and wherein said means for fixing a conductor comprises an end portion of said at least conductor which extends past said at least one projection to be wedged between said wall and said insulative material block.

12. The male electrical contact member according to claim 1, wherein said means for locking said insulative material block in said housing comprise a cover articulated to one edge of said housing having means for locking said cover to said housing in a closed position.

13. The male electrical contact member according to claim 12, wherein said cover and said housing each include an extension forming a passage for at least one conductor, and further including means for clamping said at least one conductor in said passage.

14. The male electrical contact member according to claim 13, wherein said means for clamping include grooves located on each extension.

15. The male electrical contact member according to claim 13, wherein said means for clamping include beads located on each extension.

16. The male electrical contact member according to claim 1, wherein said housing includes a skirt extending around said at least one projection for receiving a complementary shell part including at least one complementary female electrical contact member.

17. The male electrical contact member according to claim 16, wherein said skirt includes means for fixing said skirt to said complementary shell part.

18. The combination of the male electrical contact member recited in claim 16, with at least conductor and at least one complementary shell part.

19. The male electrical contact member according to claim 1, wherein each said at least one projection has opposing sides and a first end that is fixed to each said at least one heel-piece on one side of the projection, the heel-piece being extended at its ends by two cheeks which extend to the other side of projection to form thereon shoulders for defining said at least one passage for a conductor.

20. The male electrical contact member according to claim 19, further including pegs on the projection on the side on which the heel-piece is affixed for attaching a conductor.

21. An electrical connector device comprising:

two connector shells, with each connector shell including a housing;

at least one conductor;

two insulative material blocks, with each insulative material block including at least one heel-piece and at least one projection, said at least one heel-piece having at least one passage through which said at least one conductor is capable of passing;

said housing of each of said connector shells being capable of receiving one of said insulative material blocks and including a wall having at least one aperture through which said at least one projection may be inserted; and means for locking said insulative material block in each housing of each of said connector shells when said at least one projection is inserted into said at least one aperture.

22. The electrical connector device according to claim 21, wherein said at least one aperture in said wall has a width corresponding to the thickness of said at least one projection when fitted with said at least one conductor, so that when said at least one projection fitted with a conductor is inserted into said at least one aperture, each the conductor is gripped between the edges of said at least one aperture and a corresponding at least one projection.

23. The electrical connector device according to claim 21, including at least two projections and at least two conductors, with each conductor being of substantially the same length, and each conductor being folded to the extent necessary to overlap its corresponding projection.

24. The electrical connector device according to claim 21, wherein said insulative material block includes a series of projections upstanding from one side of said at least one heel-piece; and a series of corresponding slots which open on said side of said at least one heel-piece on which said series of projections are located, and onto the side of said at least one heel-piece opposite that carrying said series of projections.

25. The electrical connector device according to claim 24, wherein each slot in said series of corresponding slots opens on said side of said at least one heel-piece on which said series of projections are located at a position that is substantially adjacent to a corresponding projection.

26. The electrical connector device according to claim 21, wherein each said housing includes a skirt extending around said at least one projection for receiving a complementary shell part including at least one complementary female electrical contact member.

27. The electrical connector device according to claim 26, wherein said skirt includes means for fixing said skirt to said complementary shell part.

28. The electrical connector device according to claim 21, wherein each said at least one projection has opposing sides and a first end that is fixed to one of said at least one heel-piece on one side of the projection, the heel-piece being extended at its ends by two cheeks which extend to the other side of the projection to form thereon shoulders for defining said at least one passage for a conductor.

29. The electrical connector device according to claim 28, further including pegs on the projection on the side on which the heel-piece is affixed for attaching a conductor.

30. Male electrical contact member comprising:

a connector shell including a housing having a wall including at least one aperture;

an insulative material block comprising at least one elongated member for receiving a conductor thereon, said elongated member including a projection having opposing sides and a first end that is fixed to a protruding heel-piece on one side of said projection;

attaching means on said projection on the side on which said heel-piece is affixed for attaching a conductor;

said housing being capable of receiving said insulative material block with said at least one elongated member projecting through said at least one aperture; and means for locking said at least one elongated member in said housing when said elongated member is inserted in said at least one aperture.

31. The combination of the male electrical contact member recited in claim 30, with at least one conductor and at least one complementary shell part.

32. The male electrical contact member according to claim 30, wherein said heel-piece is extended at its ends by two cheeks which extend to the other side of said projection to form thereon shoulders for defining a passage for a conductor.

33. The male electrical contact member according to claim 32, wherein said attaching means comprise at least one peg.

34. An electrical connector device comprising:

two connector shells, with each connector shell including a housing having a wall including at least one aperture;

two insulative material blocks, with each of said two insulative material blocks comprising at least one elongated member for receiving a conductor thereon, said elongated member including a projection having opposing sides and a first end that is fixed to a protruding heel-piece on one side of said projection;

attaching means on said projection on the side on which said heel-piece is affixed for attaching a conductor;

each said housing being capable of receiving said insulative material block with said at least one elongated member projecting through said at least one aperture; and means for locking said at least one elongated member in each said housing when said elongated member is inserted in said at least one aperture.

35. A method of making an electrical connection comprising:

providing an electrical connector device including:

two connector shells, with each connector shell including a housing;

at least one duct containing at least one ribbon cable conductor;

two insulative material blocks, each of said two insulative material blocks including at least one heel-piece and at least one projection, and having at least one passage through which said at least one ribbon cable conductor is capable of passing;

said housing of each of said connector shells being capable of receiving one of said two insulative material blocks and including a wall having at least one aperture through which said at least one projection may be inserted; and means for locking the insulative material block in said housing of each of said connector shells when said projection is inserted into said at least one aperture; and connecting and locking said two connector shells to opposite ends of said duct so that said at least one ribbon cable conductor is positioned over said at least one projection.

36. The method according to claim 35, further including providing two complementary shell parts, with each of said complementary shell parts including at least one complementary female electrical contact member, and connecting each of said two connector shells to a respective one of said complementary shell parts.

37. The method according to claim 35, including at least two ribbon cable projections and at least two conductors, with each conductor being of substantially the same length, and including the step of the folding each conductor to the extent necessary to overlap its corresponding projection.

38. The method according to claim 35, wherein said complementary shell parts are attached to the interior of a vehicle and the door of the vehicle.

* * * * *